US012139913B2

(12) United States Patent
Sutton et al.

(10) Patent No.: US 12,139,913 B2
(45) Date of Patent: Nov. 12, 2024

(54) COVERED RAIN GUTTER SYSTEM

(71) Applicant: Englert, Inc., East Brunswick, NJ (US)

(72) Inventors: Edward Sutton, East Brunswick, NJ (US); Amin Jasani, Fords, NJ (US)

(73) Assignee: Englert, Inc., East Brunswick, NJ (US)

( * ) Notice: Subject to any disclaimer, the term of this patent is extended or adjusted under 35 U.S.C. 154(b) by 0 days.

(21) Appl. No.: 17/736,249

(22) Filed: May 4, 2022

(65) Prior Publication Data

US 2023/0358048 A1 Nov. 9, 2023

(51) Int. Cl.
*E04D 13/04* (2006.01)
*E04D 13/068* (2006.01)

(52) U.S. Cl.
CPC ..... *E04D 13/0481* (2013.01); *E04D 13/068* (2013.01)

(58) Field of Classification Search
CPC .. E04D 13/0481; E04D 13/068; E04D 13/076
USPC ..... 52/12
See application file for complete search history.

(56) References Cited

U.S. PATENT DOCUMENTS 891,406 A * 6/1908 Cassens ..... A61M 1/1666 248/48.2
2,712,915 A 7/1955 Cohen et al.
4,632,342 A 12/1986 Skinner
4,757,649 A * 7/1988 Vahldieck ..... E04D 13/064 52/12
5,575,118 A * 11/1996 Vahldieck ..... E04D 13/076 52/12
5,845,435 A * 12/1998 Knudson ..... E04D 13/0725 248/48.1
6,745,517 B2 6/2004 Vahldieck
7,117,643 B2 * 10/2006 Brown ..... E04D 13/064 52/12
7,730,672 B2 6/2010 Knudson et al.
7,752,812 B2 * 7/2010 Knudson ..... E04D 13/076 52/12
8,225,556 B2 7/2012 Brown
8,347,557 B2 1/2013 Minor, Sr. et al.
8,997,403 B1 * 4/2015 Steinberg ..... F16M 13/02 52/12
9,353,528 B2 5/2016 Martin
9,534,391 B2 * 1/2017 Haley ..... E04D 13/068
(Continued)

FOREIGN PATENT DOCUMENTS

CA 1194672 A1 10/1985

*Primary Examiner* — Babajide A Demuren
(74) *Attorney, Agent, or Firm* — Powley & Gibson, P.C.

(57) ABSTRACT

A rain gutter system comprises a covered rain gutter and a mounting bracket in the interior of the covered rain gutter for mounting the covered rain gutter to a structure. The covered rain gutter includes a trough portion and a cover portion with the trough portion including a lip and the cover portion including a nose configured to direct rainwater to flow toward the interior of the covered rain gutter. The mounting bracket includes a top portion, a bottom portion, and a central portion interconnecting the top and bottom portions. The top portion of the bracket can contact and support the cover portion. The bottom portion of the bracket can contact the lip of the trough portion, support the trough portion, and maintain separation between the nose and the lip of the covered rain gutter.

13 Claims, 9 Drawing Sheets

(56) References Cited

U.S. PATENT DOCUMENTS

| | | | | |
|---|---|---|---|---|
| 2004/0000098 | A1* | 1/2004 | Knudson | E04D 13/0725 52/12 |
| 2005/0082436 | A1 | 4/2005 | Snell | |
| 2005/0115190 | A1 | 6/2005 | Brown | |
| 2008/0029654 | A1 | 2/2008 | Iannelli | |
| 2015/0284961 | A1 | 10/2015 | Iannelli | |

* cited by examiner

COVERED RAIN GUTTER SYSTEM

TECHNICAL FIELD

This disclosure relates to rain gutters, and in particular, to covered rain gutters.

BACKGROUND

Rain gutters, sometimes called eavestroughs, are common on roofs to redirect rainwater away from the foundations of structures. Traditionally, gutters are uncovered which may allow debris such as leaves to collect in them. Over time, enough debris can build up and restrict water flow through the gutter, causing it to fail. Recently, covered gutters, which prevent debris from collecting and building up in the gutter, have become commonplace. Covered gutters, though, may degrade over time due to sagging issues that permit debris and even animals to enter the covered gutter.

Traditional gutters are commonly installed by attaching the back of the gutter to the fascia of a structure using fasteners. Then hidden hangers or brackets, which support the outside edge of the gutter, are also attached to the fascia of the structure. While this method works well for traditional gutters, covered gutters may require different methods for supporting the gutter with different components. For example, the covers of covered gutters require support, similar to the outside edge of an un-covered gutter, to prevent sagging and possible collapse over longer gutter runs. Current methods and devices for supporting the covers of covered gutters, as well as the gutters themselves, are unsatisfactory for a variety of reasons including difficulty to install.

SUMMARY

In general, this disclosure relates to a covered rain gutter system connecting to a structure which effectively supports both a cover and a trough of a covered gutter system. Further, this disclosure relates to preventing debris or other foreign objects from entering the covered gutter by using a unique mounting bracket.

In one embodiment, a rain gutter system for connecting to structure comprises an elongated covered rain gutter and a mounting bracket. The elongated covered rain gutter can include a trough portion having front and rear walls connected by a bottom wall with the front wall having a flange extending rearward forming a lip. The elongated covered rain gutter can further include a cover portion having a front wall and a rear wall connected by a top wall. The rear wall of the covered portion can be connected to the rear wall of the trough portion such that the cover portion is positioned at least partially over the trough portion. The front wall of the cover portion can form a nose positioned at least partially over and separated from the lip. The separation between the nose and the lip can define an opening to an interior of the covered rain gutter with the nose configured to direct rainwater to flow from an outside surface of the nose toward the interior of the covered rain gutter. The mounting bracket of the rain gutter system can be positioned in the interior of the covered rain gutter and can be configured to support the covered rain gutter. The mounting bracket can include a top portion configured to contact an interior side of the front wall and/or top wall of the cover portion to support the cover portion. The mounting bracket can also include a bottom portion configured to contact an interior side of the lip to support the trough portion. The support of the top portion and the bottom portion of the mounting bracket can maintain the separation between the nose and the lip defining the opening to the interior of the covered rain gutter. The mounting bracket can further include a central portion interconnecting the top and bottom portions of the mounting bracket.

In another embodiment, a rain gutter system for connecting to a structure comprises a covered rain gutter and a mounting bracket. The covered rain gutter can include a trough portion having a front wall and a rear wall connected by a bottom wall and a cover portion having a front wall connected to the rear wall of the trough portion via a top wall. The cover portion can extend over the trough portion and the front wall of the cover portion can extend at least partially over the trough portion, defining an opening to an interior of the covered rain gutter. The opening can be defined between the front wall of the covered portion and an end of the trough portion. The front wall of the cover portion can be configured to direct water to flow from an outside surface of the top wall toward the interior of the covered rain gutter. The mounting bracket can be positioned in the interior of the covered rain gutter and can be configured to support the covered rain gutter. The mounting bracket can comprise a top portion configured to contact at least one of an interior side of the front wall or the top wall of the cover portion and a bottom portion configured to contact the front wall of the trough portion. The top portion and the bottom portion of the mounting bracket can be configured to maintain the opening to the interior of the covered rain gutter defined between the front wall of the cover portion and the end of the trough portion. The mounting bracket can further comprise a central portion interconnecting the top portion and the bottom portion of the mounting bracket.

DETAILED DESCRIPTION

The following detailed description is exemplary in nature and is not intended to limit the scope, applicability, or configuration of the invention in any way. Rather, the following description provides some practical illustrations for implementing embodiments of the present invention. Examples of constructions, materials, and/or dimensions are provided for selected elements. Those skilled in the art will recognize that many of the noted examples have a variety of suitable alternatives.

Figure 1:
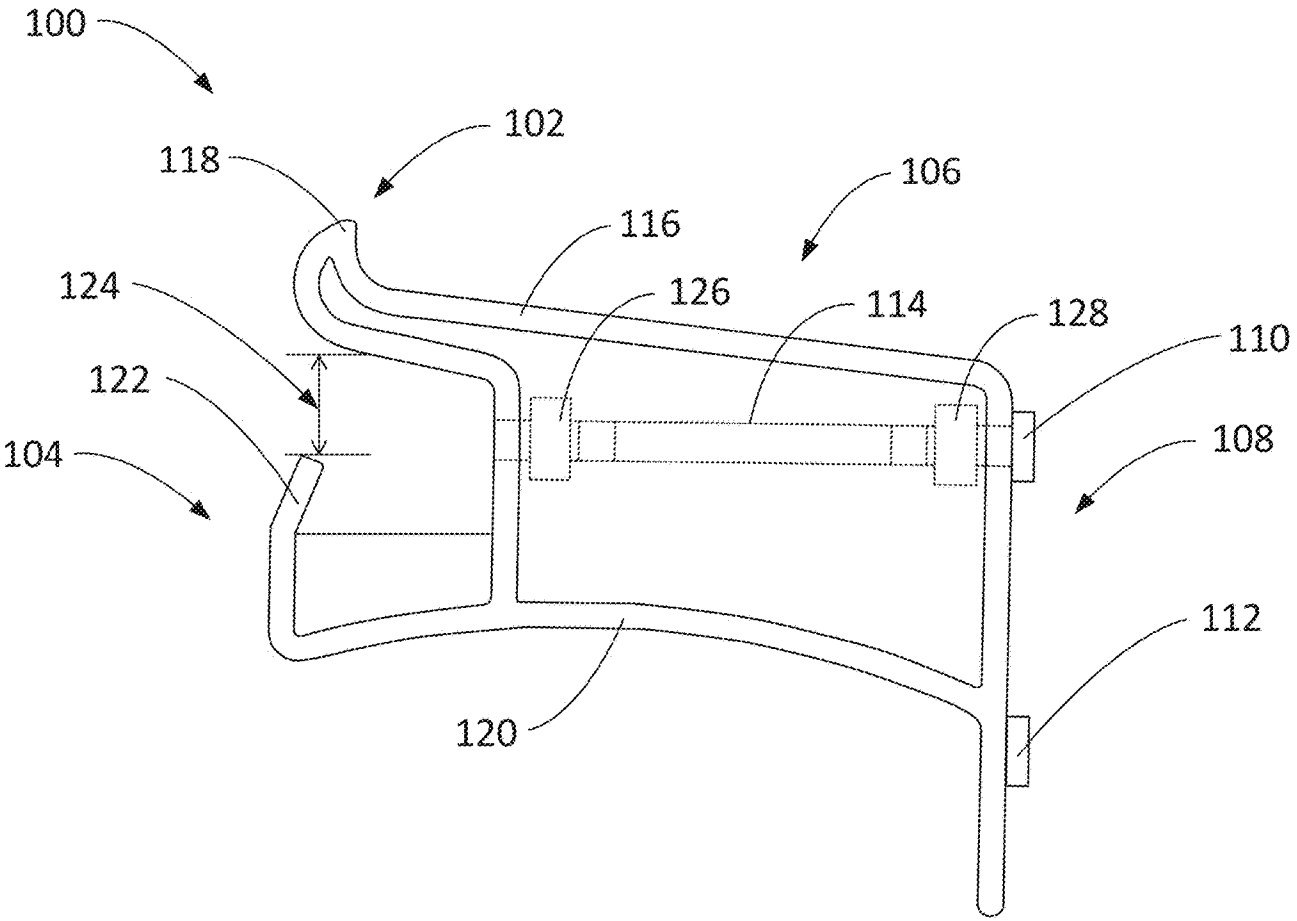
FIG. 1 is a cross-sectional view of an example mounting bracket for supporting a covered rain gutter according to an aspect of the present disclosure.

FIG. 1 is a cross-sectional view of an example mounting bracket 100 for a covered rain gutter according to an aspect of the present disclosure. The mounting bracket includes a top portion 102 a bottom portion 104, and a central portion 106 interconnecting the top portion 102 and the bottom portion 104. The central portion 106 can include a rear part 108 which can include a top protrusion 110 and a bottom protrusion 112. The central portion 106 can define a hole 114 which extends through the entire central portion 106 of the bracket to the rear part 108. In some examples, the mounting bracket 100 is made from a single piece of material, such as aluminum. Making the mounting bracket 100 out of one piece of material can increase the structural rigidity of the mounting bracket.

In FIG. 1, a top part 116 of the central portion 106 of the mounting bracket 100 is illustrated as gradually sloping upward and outward from horizontal starting at a top of the rear part 108. The central portion 106 then leads into the top portion 102 which quickly turns upward to a rounded point 118 and then downward in a shape similar to a cresting wave. In some examples, the top portion 102 of the mounting bracket 100 can be considered the front top portion of the mounting bracket.

Further in FIG. 1, a bottom part 120 of the central portion 106 is illustrated as an arch which slopes upward and outward starting at a bottom of the rear part 108. The central portion 106 then leads into the bottom portion 104 which turns upward until a point 122 at which the bottom portion 104 bends rearward. This bend 122 in the bottom portion 104 can have an angle between 0 degrees from vertical and 90 degrees from vertical. In some examples, the bottom portion 104 of the mounting bracket 100 can be considered the front bottom portion of the mounting bracket 100.

A gap 124 is defined between the top portion 102 and the bottom portion 104 of the mounting bracket 100. In some examples, the gap 124 can be defined as the smallest region between the top portion 102 and the bottom portion 104. In some examples, the gap is less than or equal to ½ inch.

In the example of FIG. 1, the rear part 108 of the central portion 106 has a top protrusion 110 and a bottom protrusion 112. In some examples, the top protrusion 110 aligns with the hole 114 defined by the central portion 106. The top protrusion 110 and the bottom protrusion 112 can extend along a length of the mounting bracket 100 and can have any thickness.

Continuing with FIG. 1, the central portion 106 defines a hole 114 which passes through the entire central portion 106. In some examples, the hole 114 is sized to fit a connector, such as a screw. The hole 114 can vary in width and can have different portions which are wider than other portions. For example, in FIG. 1, two portions 126, 128 are sized larger than the main portion of the hole. The two portions 126, 128 can be sized to fit objects such as nuts and/or washers which can be used in conjunction with the connector.

Figure 2:
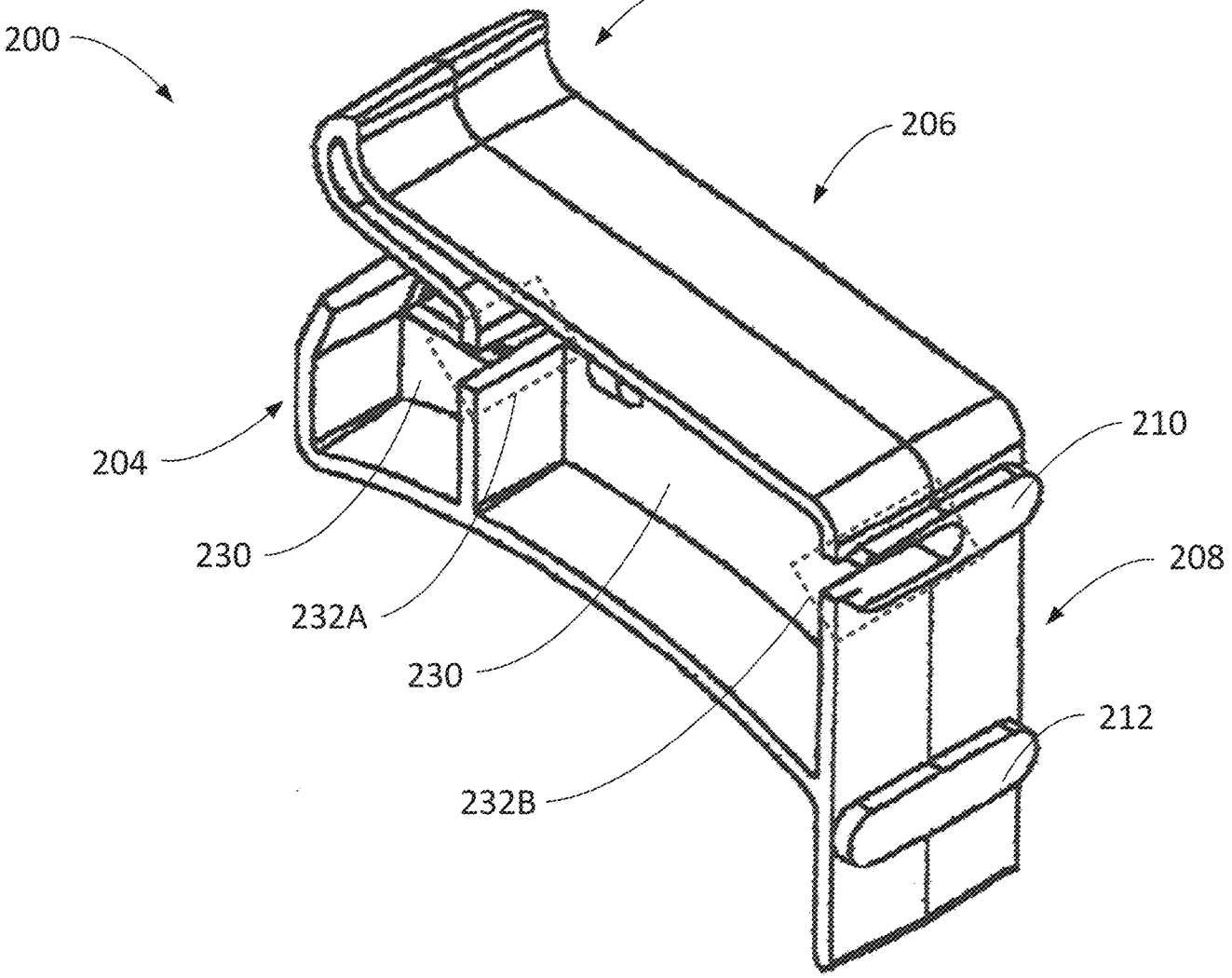
FIG. 2 is a perspective view of an example mounting bracket for supporting a covered rain gutter according to an aspect of the present disclosure.

Moving to FIG. 2, FIG. 2 is a perspective view of an example mounting bracket 200 for supporting a covered rain gutter according to an aspect of the present disclosure. As shown and described with respect to FIG. 1, the bracket of FIG. 2 includes a top portion 202, a bottom portion 204, and a central portion 206 interconnecting the top portion 202 and the bottom portion 204. The mounting bracket 200 includes bracing 230 which can extend from a front of the mounting bracket to a rear portion of the mounting bracket 200. In the example of FIG. 2, the bracing 230 extends through a centerline of the mounting bracket 200. Using a bracing can be advantageous as the bracing is lightweight while still providing structural support to the bracing.

In some examples, in addition to the hole defined by the central portion of the mounting bracket (e.g., 114 of FIG. 1) the mounting bracket 200 can also define a series of openings 232A, 232B which lead to the hole. The series of openings can be located on either side of the mounting bracket such that they enable a connector (e.g., a screw) to slide in from the same side into the hole defined by the central portion. In FIG. 2, opening 232B is located on the left side of the top protrusion 210 and opening 232A is located at the left side of central portion 206. The openings 232A, 232B are separated by approximately the same distance as the extent of the hole (e.g., 114 of FIG. 1) which extends through the central portion 206 of the mounting bracket 200. With the series of openings on one side, it is possible to insert a connector into the mounting bracket 200 before it is inserted into a covered gutter. In some examples, pre-inserting connectors into brackets via the series of openings 232A, 232B can reduce the time it takes to install the brackets.

Figure 3:
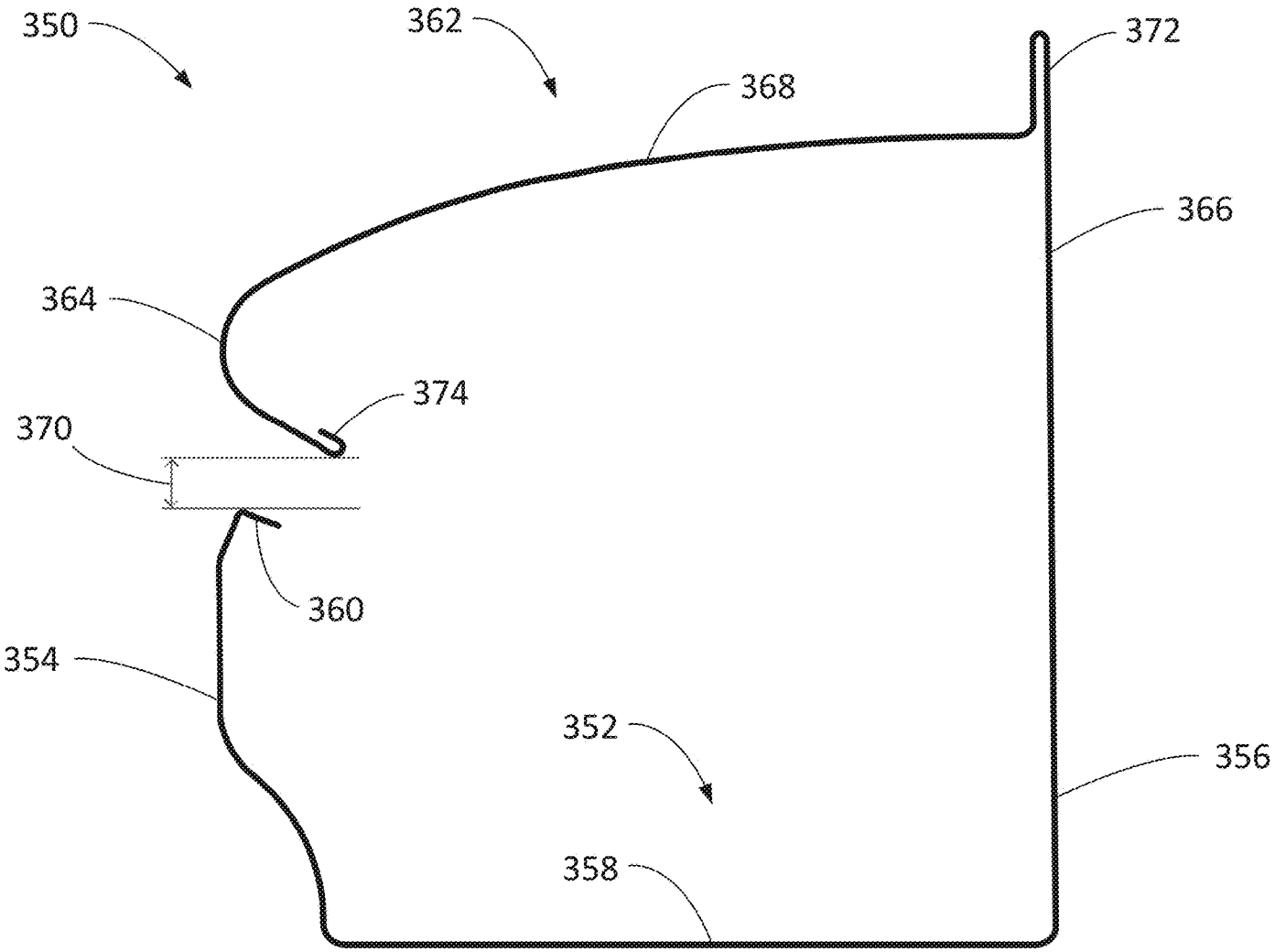
FIG. 3 is a cross-sectional view of an example covered rain gutter according to an aspect of the present disclosure.

Moving to FIG. 3, FIG. 3 is a cross-sectional view of an example covered rain gutter 350 according to an aspect of the present disclosure. The covered rain gutter 350 includes a trough portion 352 having a front wall 354, a rear wall 356, and a bottom wall 358 connecting the front and rear walls of the trough portion 352. The covered rain gutter 350 further includes a cover portion 362 which has a front wall 364, a rear wall 366, and a top wall 368 connecting the front and rear walls of the cover portion 362. In some examples, the rear wall 356 of the trough portion 352 is the same as the rear wall 366 of the cover portion 362. However, in some examples, the rear wall 356 of the trough portion 352 is merely connected to the rear wall 366 of the cover portion 362.

The front wall 354 of the trough portion 352 can extend outward from the bottom wall 358 and can take many shapes. In FIG. 3, the front wall 354 initially curves outward and upward, then curves until it extends approximately vertically, and then bends inward/rearward and upward in a planar manner. A first portion of the front wall 354 can be the portion that extends outward and upward while a second portion of the front wall 354 can be the portion that bends inward/rearward and upward. However, in some examples, the front wall can extend directly upward and/or rearward and in some examples, the front wall takes a different shape while extending upward (e.g., various curves outward and/or inward). The front wall 354 of FIG. 3 has a flange at an end of the front wall 354 that extends rearward toward the rear wall 356 and forms a lip 360. The lip 360 generally bends downward toward the bottom wall 358 and rearward toward the rear wall 356 of the trough portion 352. However, in some examples, the lip can bend upwardly and rearwardly. The bend that forms the lip 360 can increase the rigidity of the front wall 354 of the trough portion in addition to increasing the rigidity of the lip 360. The lip 360 can extend inward any amount, however a longer lip may have decreased strength relative to a shorter lip.

Additionally, the lip 360 and can have any angle relative to the front wall and/or the flange that then forms the lip 360. The angle of the lip 360 can be defined in many different ways, however, in some examples, the angle of the lip 360 is defined relative to horizontal. For instance, in the illustrated embodiment of FIG. 3, the lip 360 is at an angle between −90 degrees and 0 degrees relative to horizontal (e.g., extending downward and rearward). In some examples, the lip 360 has an angle between −90 degrees and 0 degrees relative to horizontal. By having an angle between −90 degrees and 0 degrees, the lip 360 extends downward and rearward relative to horizontal. Because the lip 360 extends both downward and rearward, it can enable the front wall 354 of the trough portion 352 to have a support which is discussed further elsewhere herein. The lip 360 illustrated in FIG. 3 is only one embodiment of a lip and a person having ordinary skill in the art will appreciate that the lip can be made from multiple flanges which can have different angles and lengths. In some examples, the lip can be considered a crimp. In some examples, the front wall of the trough portion does not have any lip.

Continuing with FIG. 3, the cover portion 362 of the covered rain gutter 350 includes the front wall 364, the rear wall 366, and the top wall 368 connecting the front and rear walls. In some examples, the top wall 368 is connected to the rear wall 366 via an elongated portion 372 that extends vertically. The elongated portion 372 can be used with flashing for a roof to prevent water from running down from the roof and behind the covered rain gutter 350. The cover portion 362 is positioned such that it at least partially covers the trough portion 352. Specifically in the illustrated example, the top wall 368 of the cover portion 362 extends over and covers the extent of the bottom wall 358 of the trough portion 352.

Further, the front wall 364 of the cover portion 362 can form a rounded nose that is positioned at least partially over and separated from the lip 360 of the trough portion 352. The separation between the rounded nose of the front wall 364 and the lip 360 of the trough portion can define an opening 370 that leads to an interior of the covered rain gutter 350. In some examples, the opening 370 is defined as the smallest region between front wall 354 and the lip 360 extending horizontally. When in use, water can flow over an outside surface of the cover portion 362 to the front wall 364 and into the interior of the covered rain gutter 350. In some examples, the rounded nose of the front wall 364 can have a specific shape that enables water to adhere to the rounded nose and flow into the interior of the covered rain gutter without falling away. The shape of the rounded nose and the configuration of the opening 370 together can allow liquids to flow into the interior of the covered rain gutter 350 while preventing debris (e.g., leaves, branches, pine needles) from entering. Such a configuration can prevent the covered rain gutter 350 from clogging with debris.

The front wall 364 can also include a fold 374 which can be formed by folding an end of the front wall 364 back on itself. The fold 374 can increase the strength of the end of the front wall 364 so that it does not bend easily in an undesirable direction or break off from the front wall 364.

Figure 4:
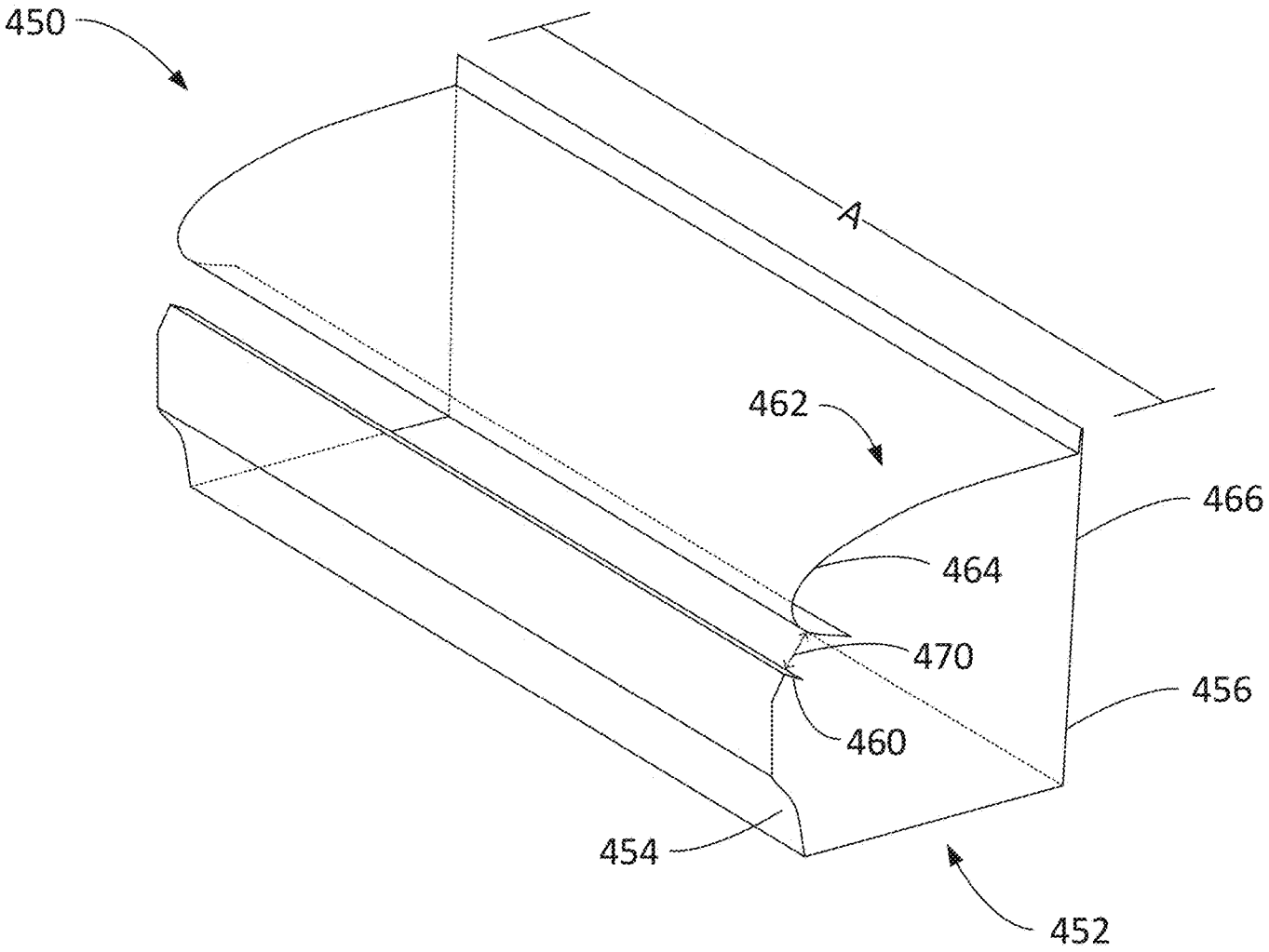
FIG. 4 is a perspective view of an example covered rain gutter according to an aspect of the present disclosure.

Moving to FIG. 4, FIG. 4 is a perspective view of an example covered rain gutter 450 according to an aspect of the present disclosure. The covered rain gutter 450 is elongated and has a length "A" which can have any length. As described elsewhere herein, the covered rain gutter 450 includes a cover portion 462 having a front wall 464 and a rear wall 466. The covered rain gutter further includes a trough portion 452 having a front wall 454 and a rear wall 456. The front wall 454 of the trough portion 452 also has a flange that extends rearward from the front wall 454 and forms a lip 460. The lip 460 and the front wall 464 of the cover portion define an opening 470 therebetween that extends along the length "A" of the covered rain gutter 450.

As illustrated in FIG. 3 and FIG. 4, the covered rain gutter 450 can be made from a single piece of material. For instance, in some examples, the covered rain gutter 450 is made from a single sheet of metal (e.g., aluminum) that is rolled and/or folded into a specific profile. Using a single piece of material can be advantageous as no seams are created along a length of the gutter which can prevent leaks. However, in some examples, the covered rain gutter 450 can be made from multiple pieces of material which can be coupled to each other via various means (e.g., fasteners, welding, adhesives). In some examples, the "cover" portion of the covered rain gutter is made from a separate sheet of material than the "gutter" portion of the covered rain gutter.

Figure 5:
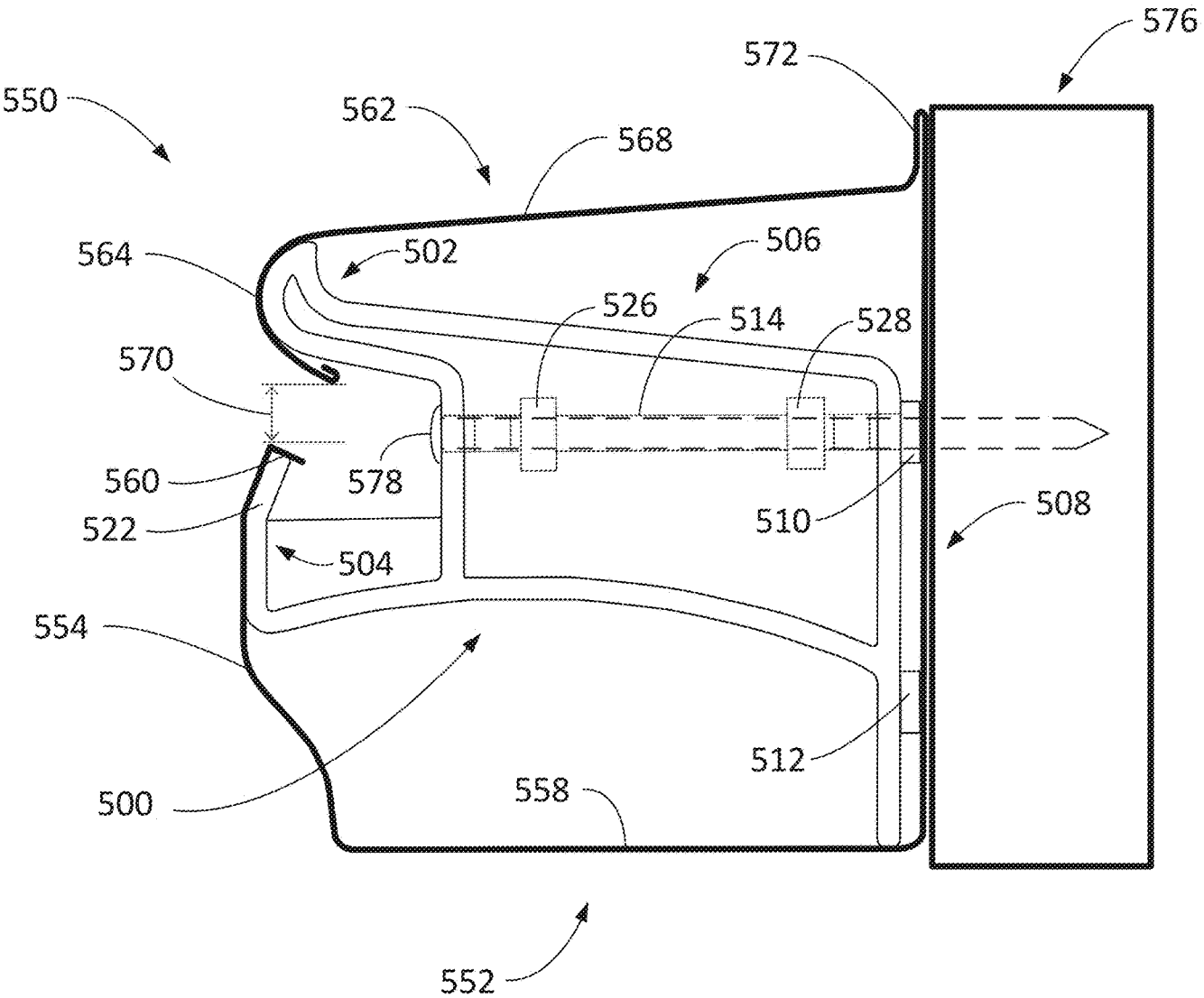
FIG. 5 is a cross-sectional view of an example mounting bracket supporting a covered rain gutter according to an aspect of the present disclosure.

Moving to FIG. 5, FIG. 5 is a cross-sectional view of an example mounting bracket 500 that is supporting a covered rain gutter 550 according to an aspect of the present disclosure. The mounting bracket 500 sits inside of the covered rain gutter 550 and is secured to both the covered rain gutter and a structure 576 (e.g., a facia part of a house) with a connector 578. The connector 578 goes through the hole 514 of the mounting bracket 500, through the rear of the covered rain gutter 550, and into the structure 576 to secure the covered rain gutter 550 to the structure 576. The connector can be any type of connector such as a fastener (e.g., screw, nail, bolt). In some examples, more than one connector is used. In the example of FIG. 5, two portions 526, 528 of the hole 514 can enclose nuts and/or washers which engage with the connector 578. In some examples, the two portions 526, 528 enclose threaded portions of the mounting bracket 500 which engage with the connector 578. When the connector 578 is secured to the structure 576, the nuts, washers, or threaded portions of the mounting bracket can help secure the connector 578 to the mounting bracket 500, which then provides support for the mounting bracket. Because the connector 578 of FIG. 1 is located fairly high above the bottom wall 558 of the trough, the connector will avoid being exposed to water in the gutter which can prevent possible corrosion of the connector.

The mounting bracket 500 provides support for various portions of the covered rain gutter 550 so that the covered rain gutter 550 is not only supported by the connector securing it to the structure 576. For instance, the top portion 502 of the mounting bracket 500 is configured to contact an interior side of the front wall 564 and/or top wall 568 of the cover portion 562. As illustrated in the example of FIG. 5, the top portion 502 of the mounting bracket 500 can have a convex curve that matches the concave/rounded nose of the front wall/top wall of the cover portion 562. Matching the curve of the mounting bracket 500 with the rounded nose of the cover portion 562 can provide support for the front wall 564 of cover portion 562 and prevent it from bending due to any loads acting on top of it (e.g., snow buildup, large branches).

Further in FIG. 5, the bottom portion 504 of the mounting bracket 500 is configured to contact an interior side of the lip 560 of the covered rain gutter. The contact between the bottom portion 504 of the mounting bracket 500 and the lip 560 provides support to the trough portion 552 of the covered rain gutter. For example, the trough portion 552, especially the front wall 554, is supported by the mounting bracket 500 and is prevented from being pulled downward by a load (e.g., water in the trough portion 552).

Additionally, the top protrusion 510 and the bottom protrusion 512 of the mounting bracket 500 can aid in supporting the covered rain gutter. The protrusions 510, 512 contact the rear of the covered rain gutter 550 with the top protrusion allowing the connector 578 to pass through it and secure to the structure 576. The bottom protrusion 512, while not connected to the structure 576, can act as a brace against the structure 576 though the covered rain gutter. While the rear of the covered rain gutter 550 does act in a similar manner, the covered rain gutter 550 is usually made from a thinner material that will bend more easily under loads when compared to the mounting bracket 500 and the bottom protrusion 512.

Furthermore, the shape of the mounting bracket 500 can provide support to the covered rain gutter 550. For example, the bottom portion of the mounting bracket 500 can be shaped in an arch and the top portion of the mounting bracket 500 can slope upward, both of which can provide increased support when compared to a horizontal line.

Thus, in conjunction with the connector 578 securing the rear of the covered rain gutter 550 to the structure directly, the mounting bracket 500 can support and secure the front of the covered rain gutter 550 and the rear of the covered rain gutter.

As discussed elsewhere herein, the front wall 564 of the cover portion 562 can have a rounded nose which is shaped specifically to allow liquids to follow along it and into the interior of the covered rain gutter 550. In practice, liquids will drop down along some portion of the front wall 564 that faces downward and fall either directly into the trough portion 552 or hit the front wall 554 of the trough portion 552 and run into the trough portion 552. If, however, the opening 570 defined between the front wall 554 of the trough portion 552 and the front wall 564 of the cover portion 562 is not within a desired range (e.g., too small), liquids may end up flowing out and away from the covered rain gutter 550, thereby defeating the purpose of the gutter. Additionally or alternatively, if the opening 570 is too large, debris, animals, or other unwanted elements may enter the covered rain gutter 550 and possibly create a clog, again defeating the purpose of the gutter. The mounting bracket 500, though, can maintain the size of the opening 570 into the interior of the covered rain gutter 550. Because the lip 560 of the covered rain gutter 550 contacts the bottom portion 504 of the mounting bracket 500, and the front wall 564 of the cover portion 562 contacts the top portion 502 of the mounting bracket 500, the mounting bracket 500 can maintain the size of the opening 570. In some examples, the mounting bracket 500 can maintain the size of the opening to ½ inch+/−¼ inch. In some examples, the mounting bracket can maintain the size of the opening to between ½ inch and 1/16 inch.

In FIG. 5, the opening 570 defined between the font wall 564 of the cover portion 562 and the front wall 554 of the trough portion 552 is aligned with the opening (e.g., 124 of FIG. 1) defined between the top portion 502 and the bottom portion 504 of the mounting bracket. These openings can be further aligned with the hole 514 defined by the central portion 506 of the mounting bracket 500. The alignment can be approximate or complete with respect to the horizontal plane. For instance, in the example of FIG. 5, the hole 514 has a small portion which does not lie within a horizontal extension of the opening 570, though in some examples, the hole 514 lies completely within a horizontal extension of the opening 570. Alignment of the opening 570 with the hole 514 of the mounting bracket 500 can be advantageous as an installer installing the covered rain gutter 550 with the mounting bracket 500 can use a tool to tighten the connector 578 without needing to bend or otherwise manipulate the covered rain gutter 550. For example, an installer can use a drill to drive a screw, which can be already inserted into the hole 514 of the mounting bracket 500, through the mounting bracket 500 and into the structure 576 without having to manipulate the covered rain gutter 550. Alignment of the opening 570 and the hole 514 can thus decrease the time it takes to install the covered rain gutter 550 and can prevent damage to the covered rain gutter 550 when installing.

Figure 6:
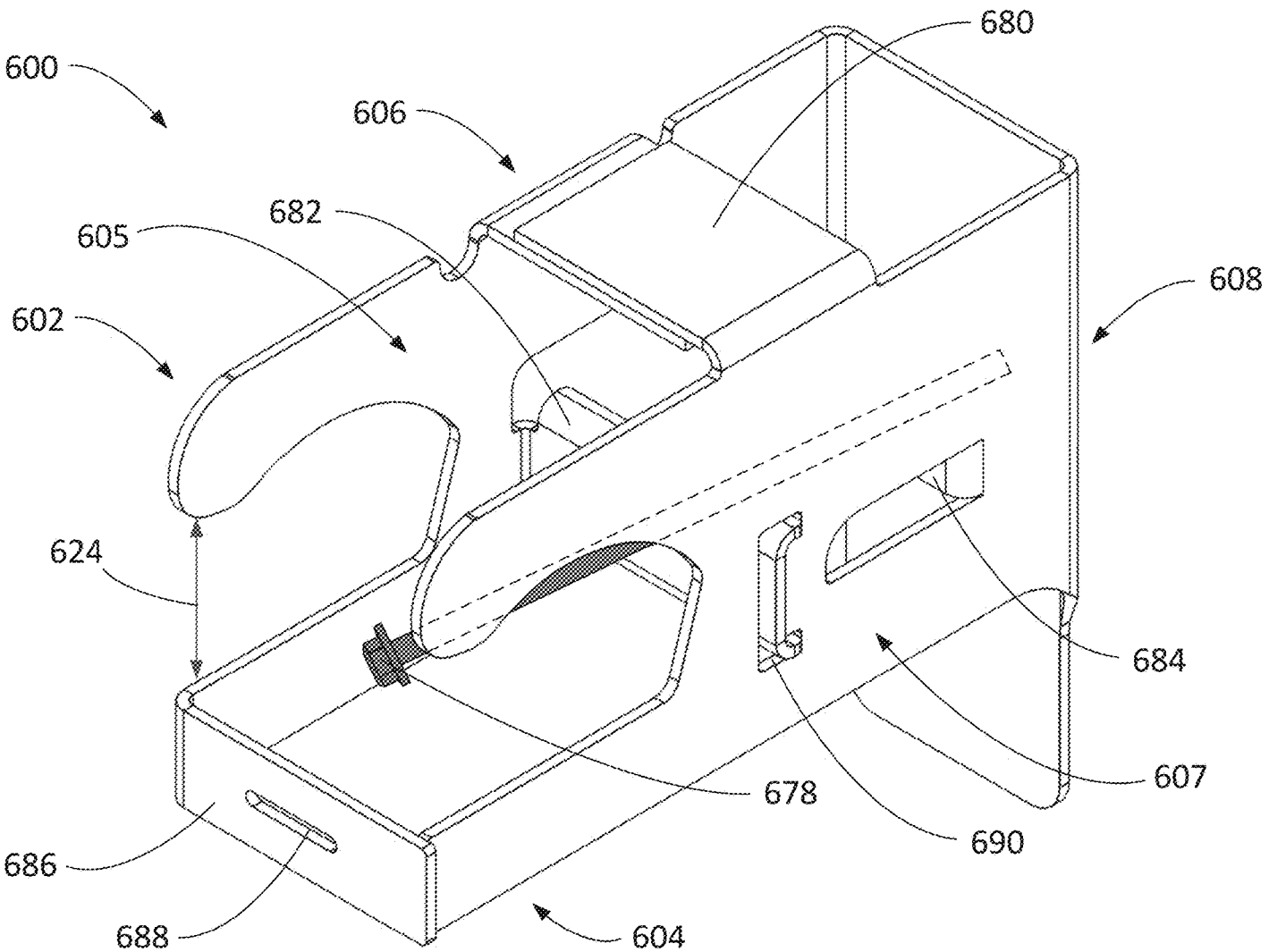
FIG. 6 is a perspective view of an example mounting bracket for supporting a covered rain gutter according to an aspect of the present disclosure.

Moving to FIG. 6, FIG. 6 is a perspective view of an example mounting bracket 600 for supporting a covered rain gutter according to an aspect of the present disclosure. The mounting bracket 600 includes a top portion 602, a bottom portion 604, and a central portion 606 interconnecting the top portion 602 and the bottom portion 604. The top portion 602 is made from two parts that are separated from each other. In some examples, though, the top portion is made from a single part. The central portion 606 can include a rear part 608, a top part 680, a connector support 682, and a connector aligner 684. The rear part 608, the connector support 682, and the connector aligner 684 each define a hole (seen in FIG. 7) which extends through the central portion 606 of the mounting bracket 600 and through the rear part 608. A connector 678 can connect the mounting bracket 600 through the hole via the connector support 682, the connector aligner 684, and the rear part 608.

FIG. 6 also includes a left side panel 605 and a right side panel 607. The left side panel 605 and the right side panel 607 are connected to each other via the rear part 608 which in some examples, can be considered a rear panel. In the illustrated example, the left side panel 605 and the right side panel 607 are bent relative to the rear part 608. In some examples, the left side panel and the right side panel are formed via bending relative to the rear part while in some examples, the left side panel and the right side panel are formed via welding or other means. Each of the left side panel 605 and the right side panel 607 comprise a top portion (e.g., 602) configured to contact an interior side of a front wall of a cover portion to support the cover portion, a bottom portion, and a central portion interconnecting the top and bottom portions. In some examples, the left side panel and the right side panel can be described as being portions of the top portion 602, the bottom portion 604, the central portion 606.

In FIG. 6, the top part 680 of the central portion 606 can be formed by bending a tab from each side (e.g., a left side panel 605 and right side panel 607) on top of one another. For instance, in FIG. 6, the right side panel tab is bent on top of the left side panel tab. In some examples, the tabs from each side are secured together (e.g., welded) to form the top part 680 which can provide increased rigidity to the central portion 606 and to the overall mounting bracket 600.

In comparison to the example mounting bracket of FIG. 1, the central portion 606 of the mounting bracket 600 of FIG. 6 does not have a top part that gradually slopes upward and outward from the rear part 608. Instead, the top of the mounting bracket of FIG. 6 extends outward approximately orthogonal from the rear part 608 until the top portion 602. Similarly, the central portion 606 of the mounting bracket of FIG. 6 does not have as extensive an arched bottom part that slopes upward and outward from the rear part 608 as in the example mounting bracket of FIG. 1. In some examples, the mounting bracket of FIG. 1 can support a heavier load (e.g., a heavier cover on a covered gutter) than the mounting bracket 600 of FIG. 6. However, in some examples, the mounting bracket 600 of FIG. 6 is easier and cheaper to manufacture than the bracket of FIG. 1 and provides sufficient support to a covered gutter.

In further comparison to the example bracket of FIG. 1, the bottom portion 604 of FIG. 6 is configured differently than the bottom portion of FIG. 1. The bottom portion 604 of FIG. 6 can comprise two side parts (e.g., a left part and a right part). Alternatively, in some examples, the left side panel 605 and the right side panel 607 each comprise a bottom portion. The bottom portion of one of the left side panel 605 or the right side panel can be bent at an angle to form a bottom portion front part 686 which can be engaged with the other bottom portion of one of the left side panel 605 or the right side panel 607. In some examples, the bottom portion front part 686 is secured to the other of the left side panel 605 or the right side panel 607 and forms a box-like structure. For instance, the bottom portion front part 686, formed from a bottom portion of the left side panel 605, can be welded to the bottom portion of the right side panel 607 and form the bottom portion 604. In some examples, the bottom portion front part 686 can define an opening 688. In some such examples, the opening 688 can be sized to accept a fastener as is described elsewhere herein.

Continuing with FIG. 6, a gap 624 is defined between the top portion 602 and the bottom portion 604 of the mounting bracket 600. In some examples, the gap 624 can be defined as the smallest region between the top portion 602 and the bottom portion 604. In some examples, the gap is approximately equal to, or less than ½ inch.

Figure 7:
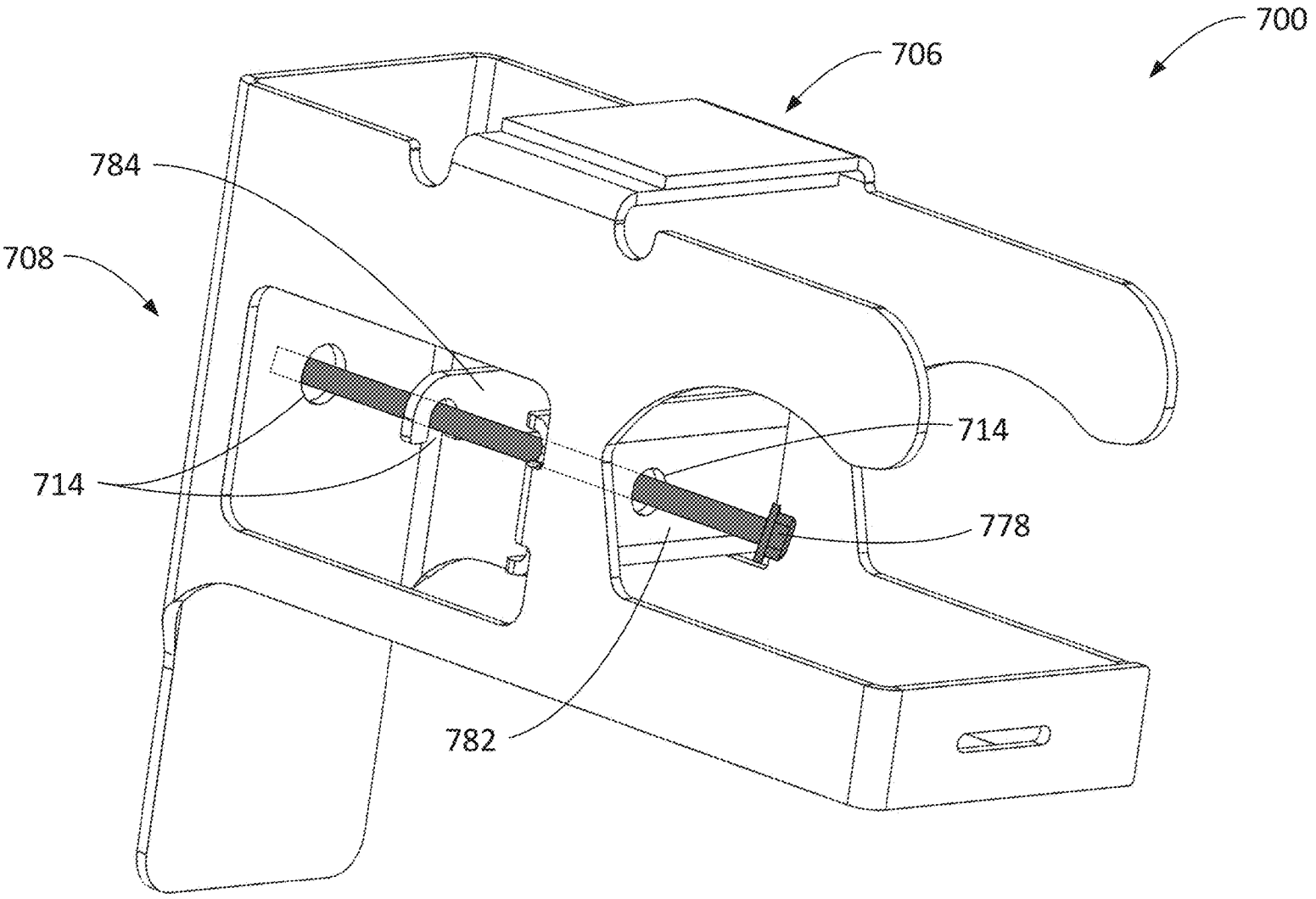
FIG. 7 is a perspective view of the example mounting bracket of FIG. 6 for supporting a covered rain gutter according to an aspect of the present disclosure.

Moving to FIG. 7, FIG. 7 is a perspective view of the example mounting bracket of FIG. 6 for supporting a covered rain gutter according to an aspect of the present disclosure. The mounting bracket 700 includes a central portion 706 having a rear part 708, a connector support 782, and a connector aligner 784. The rear part 708, the connector support 782, and the connector aligner 784 each define holes 714 which are aligned with each other. A connector 778 can pass through the holes 714 and can secure to any one or more of the parts defining the holes 714. For example, in FIG. 7, the connector 778 can be threaded (e.g., a screw or bolt) along with the hole of the rear part 708 and the hole of the connector support 782. The threads from the connector 778 can secure with the threads of the hole of the rear part 708 and the hole of the connector support 782 such that the connector is secured to the mounting bracket 700. As is described elsewhere herein, the connector 778 can secure the mounting bracket 700 with a structure positioned behind the rear part 708.

In some examples, the mounting bracket 700 is formed from a single piece of material. For instance, in some examples, the mounting bracket is stamped from a flat sheet of metal and formed (e.g., via bending) into the shape of the mounting bracket. Stamping the mounting bracket from a flat sheet of metal or other material can decrease costs of the mounting bracket and increase the simplicity of forming the bracket when compared to other methods of forming the mounting bracket (e.g., casting, injection molding). Additionally, using a single piece of material to form the mounting bracket 700 can increase the strength of the mounting bracket as it does not have joints between materials that may break. In some examples, however, the bracket can be made from multiple pieces of material (e.g., aluminum) that are coupled together via various means (e.g., welding, fasteners, adhesives).

Referring both the FIG. 6 and FIG. 7, the connector aligner 784 and the connector support 782 can both be formed from the central portion 706 through folding of the central portion 706. For instance, the connector aligner 784 and the connector support 782 are folded inward inside of the central portion 706 such that the holes 714 they define align and enable a connector 778 to connect through them. The connector aligner 784 and the connector support 782 can be folded at any angle relative to the central portion 706 so long as their holes 714 align and enable a connector 778 to connect through them. In some examples, the connector aligner 784 and the connector support 782 are folded at approximately a 90 degree angle relative to the central portion 706. In some examples, the connector aligner 784 is optional, however in some examples, the connector aligner 784 can help prevent the connector 778 from pushing, bending, or ripping upward through the mounting bracket 700 due to forces acting downward on the mounting bracket 700 (e.g., a heavy load on the bracket).

In the example of FIG. 6 and FIG. 7, the connector support 782 can additional be bent on its top and bottom, such as in a "C" shape to strengthen it. Further, the central portion 706 can include an opening (e.g., 690) that accepts an unconnected end of the connector support 782. The opening can be shaped to accept any bends of the connector support 782. For instance, in FIG. 6, the opening 690 is shaped in a "C" which accepts the "C" shape of the connector support 682. The unconnected end of the connector support 682 can rest on, and be supported by, the central portion 606 which defines the opening 690. In some examples, the unconnected end of the connector support can be secured to the central portion (e.g., via a weld) instead of resting on the central portion through an opening. The connector support 782 can thus be supported at both of its ends by the central portion, such as in FIG. 6 and FIG. 7 where the connector support is folded from the central portion at one end and rests on the central portion within an opening at the other end. By supporting both ends of the connector support, the connector support can support the connector and aid in the connector securing to the bracket.

Figure 8B:
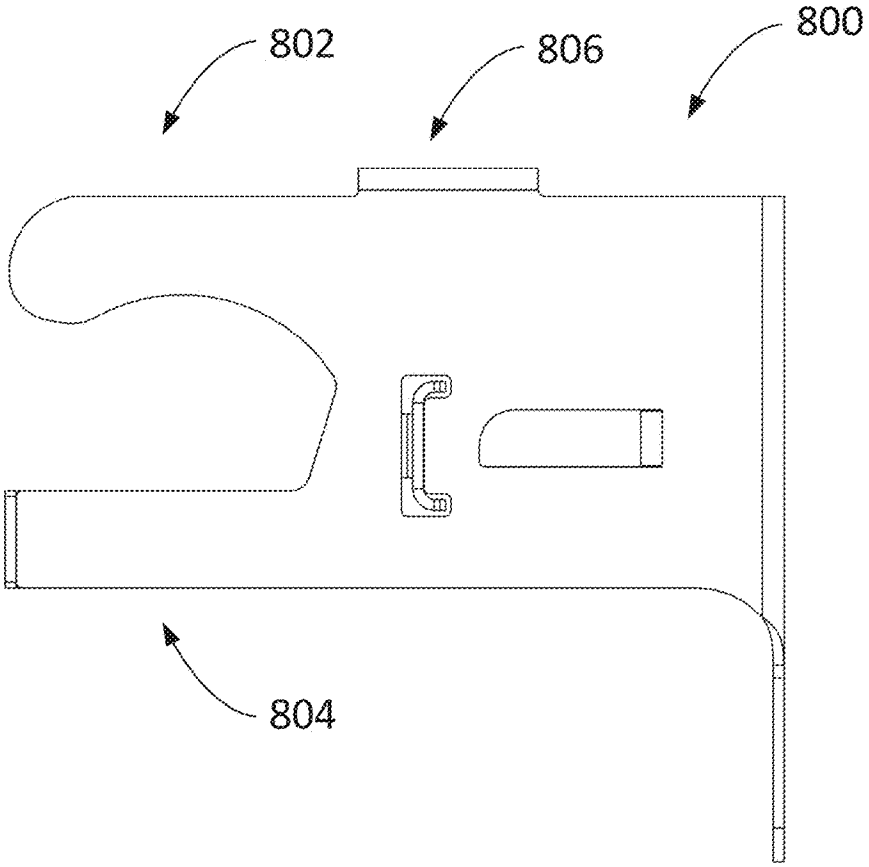
FIG. 8B is an opposite side view of the example mounting bracket of FIG. 8A for supporting a covered rain gutter according to an aspect of the present disclosure.
Figure 8A:
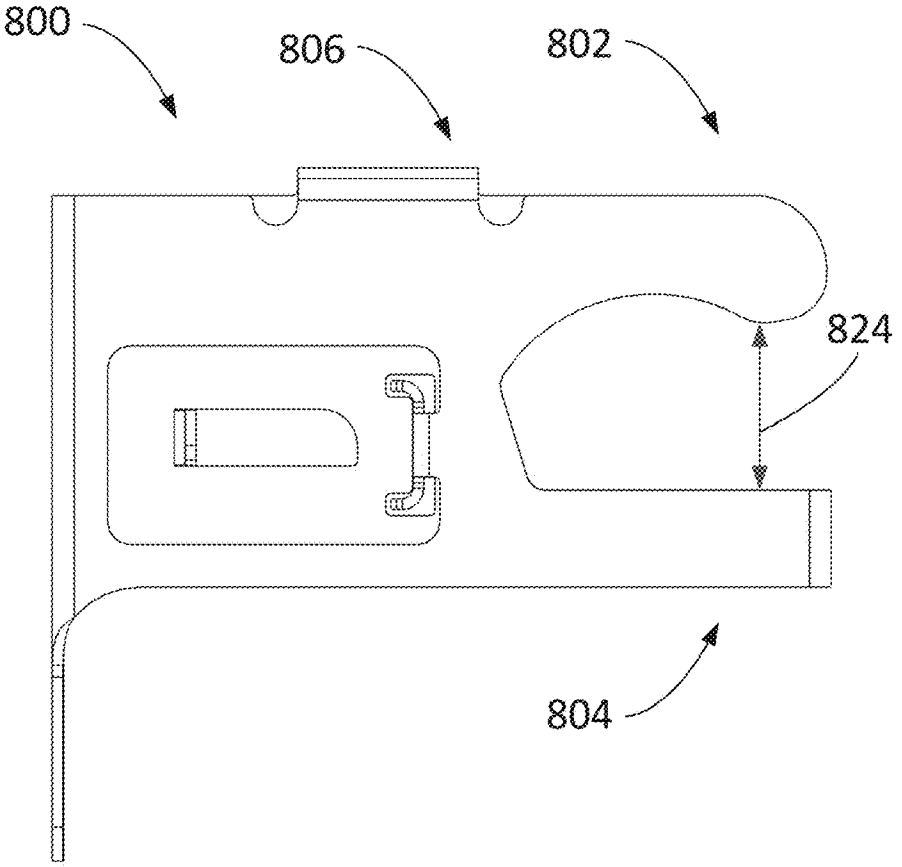
FIG. 8A is a side view of an example mounting bracket for supporting a covered rain gutter according to an aspect of the present disclosure.

Moving to FIG. 8A and FIG. 8B, FIG. 8 A/B are opposing side views of an example mounting bracket for supporting a covered rain gutter according to an aspect of the present disclosure. The mounting bracket has a top portion 802, a bottom portion 804, and a central portion 806 interconnecting the top portion 802 and the bottom portion 804. In comparison to the top portion of the example mounting bracket of FIG. 1, the top portion 802 has a different rounded profile and is made from two separate parts connected by the central portion 806 (e.g., as seen in FIG. 6 and FIG. 7). In some examples, the top portion 802 is rounded and convex. In FIG. 8A/8B, the top portion 802 remains level with the top of the central portion 806 until it turns downward and forms a rounded nose. The top portion 802 then turns rearward into the central portion, forming an arch which extends upward from a bottommost part of the rounded nose. The rounded profile or nose of the top portion 802 can be considered a full "bullnose" profile.

A gap 824 is defined between the top portion 802 and the bottom portion 804 of the mounting bracket 800. In some examples, the gap 824 can be defined as the smallest region between the top portion 802 and the bottom portion 804. In some examples, the gap is less than or equal to ½ inch.

Figure 9:
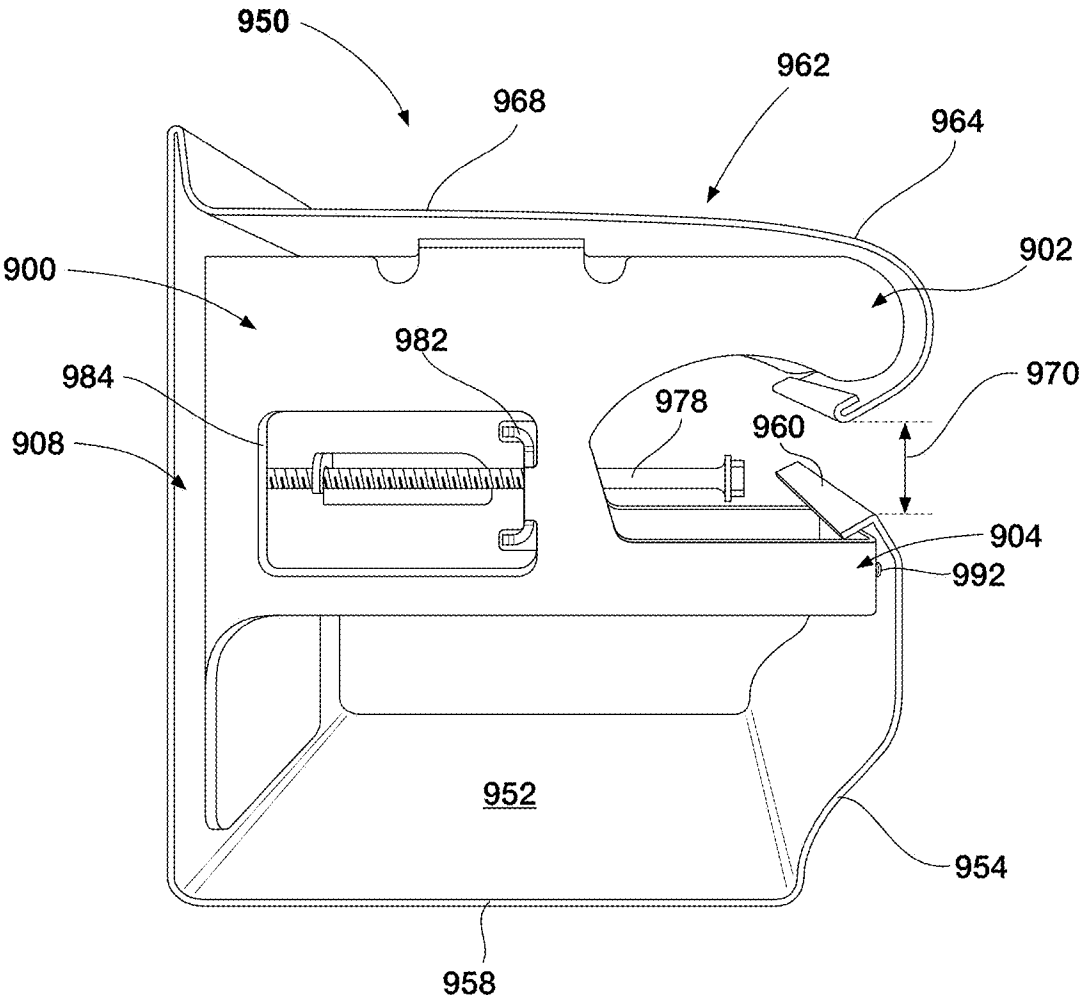
FIG. 9 is a side-perspective view of an example mounting bracket supporting a covered rain gutter according to an aspect of the present disclosure.

Moving to FIG. 9, FIG. 9 is a side-perspective view of an example mounting bracket 900 supporting a covered rain gutter 950 according to an aspect of the present disclosure. While not explicitly shown in FIG. 9, the connector 978 can secure the mounting bracket 900 to the covered rain gutter 950 and to a structure (e.g., 576 of FIG. 5). The connector 978 can pass through the holes defined by the connector support 982, the connector aligner, 984, and the rear part 908 and engage a structure in similarity with FIG. 5. The mounting bracket 900 supports the cover portion 962 and the trough portion 952 of the covered rain gutter 950. In the example of FIG. 9, the top portion 902 of the mounting bracket 900 supports the cover portion 962 and the bottom portion 904 supports the trough portion 952 of the covered rain gutter 950. The rounded nose, or full "bullnose" of the top portion 902 can have a similar rounding to the front wall 964 of the cover portion 962 and can contact an interior side of the front wall 964 and/or top wall 968, thereby providing support for the cover portion 962. The bottom portion 904 of the mounting bracket 900 can support the trough portion 952 of the covered rain gutter 950 in more than one way. For instance, in some examples the front wall 954 of the trough portion 952 can include a lip 960 that rests upon the bottom portion 904. In such examples, the bottom portion 904 of the mounting bracket supports the lip 960, thereby supporting the trough portion 952 and preventing the front wall 954 of the trough portion 952 from being pulled or bent downward. Alternatively, in some examples, the lip 960 can secure to the bottom portion 904 of the mounting bracket 900 in a similar manner as shown and described in FIG. 5. In such examples, the bottom portion 904 of the mounting bracket supports the lip 960, thereby supporting the trough portion 952 and preventing the front wall 954 of the trough portion 952 from being pulled or bent downward. Additionally or alternatively, in some examples, the front wall 954 of the trough portion 952 is secured to the bottom portion 904 via a fastener 992. The fastener 992 can secure to the bottom portion 904 of the bracket via an opening (e.g., 688) which can be sized to fit the fastener 992. In some such examples, the trough portion does not include a lip. The fastener 992 can be any type of fastener (e.g., nail) and can, in some instances, include washers and/or nuts to secure the bottom portion 904 to the front wall 954. Using the lip 960 and/or a fastener 992 secures the bottom portion 904 of the mounting bracket with the trough portion 952 of the covered rain gutter 950 and provides support to the trough portion 952.

By supporting and/or securing the cover portion 962 and the trough portion 952 with/to the mounting bracket 900, the covered rain gutter 950 can maintain a size of an opening 970 defined between the front wall 964 of the cover portion 962 and the front wall 954 of the trough portion 952. In some examples, the size of the opening 970 is maintained to be ½ inch or smaller. Maintaining the size of the opening 970 can be advantageous as it can prevent ingress of animals, insects, debris etc. into the covered rain gutter 950, which can prevent clogging of the covered rain gutter 950. Furthermore, the opening 970 can be aligned with the holes defined by the connector support 982, the connector aligner 984, and the rear part 908. This alignment can enable faster installation of the mounting bracket 900 and decrease possible damage to the covered rain gutter because a tool can engage with the connector 978 through the opening 970 without moving the cover portion 962 or the trough portion 952 significantly out of the way.

While not shown in FIG. 9, many mounting brackets can be used to secure the covered rain gutter to a structure. In some examples, the mounting brackets are approximately evenly spaced to support and mount the covered rain gutter to the structure. In some examples, the mounting brackets can be inserted into an open end of the covered rain gutter (such as the open end illustrated in FIG. 9) and are slid along the covered rain gutter to a desired position. In some examples, the mounting brackets have connectors (e.g., 978) pre-inserted into the holes defined by the connector support 982, the connector aligner 984, and the rear part 908 of the before the mounting brackets are inserted into a covered rain gutter. By pre-inserting connectors, an installer can more quickly install (e.g., secure) the covered rain gutter to a structure.

Various examples have been described. These and other examples are within the scope of the following numbered embodiments.

The invention claimed is:

1. A rain gutter system for connecting to a structure, comprising:

an elongated covered rain gutter, comprising:

a trough portion having front and rear walls connected by a bottom wall, the front wall comprising a first portion that extends upward and outward from the bottom wall of the trough portion and a second portion that extends upward and rearward from the first portion, the second portion connected to a flange forming and terminating in a lip, the lip extending downward and rearward at an angle of between −90 and 0 degrees relative to horizontal;

a cover portion having a front wall and a rear wall connected by a top wall, the rear wall of the cover portion connected to the rear wall of the trough portion such that the cover portion is positioned at least partially over the trough portion, the front wall of the cover portion forming a nose positioned at least partially over and separated from the lip, the separation between the nose and the lip defining an opening to an interior of the covered rain gutter, the nose configured to direct rainwater to flow from an outside surface of the nose toward the interior of the covered rain gutter;

a mounting bracket for positioning in the interior of the elongated covered rain gutter and configured to support the covered rain gutter, the mounting bracket comprising:

a top portion configured to contact an interior side of the front wall and/or the top wall of the cover portion to support the cover portion, a bottom portion configured to contact an interior side of the lip to support the trough portion, the support of the top portion and the bottom portion of the mounting bracket maintaining the separation between the nose and the lip defining the opening to the interior of the covered rain gutter, and a central portion interconnecting the top and bottom portions of the mounting bracket.

2. The rain gutter system of claim 1, wherein the mounting bracket is configured to maintain the separation between the nose and the lip defining the opening to the interior of the covered rain gutter to about ½ inch or smaller.

3. The rain gutter system of claim 1, further comprising a connector that connects to and mounts the mounting bracket and the covered rain gutter to the structure.

4. The rain gutter system of claim 3, wherein the central portion of the mounting bracket defines a hole extending through the central portion of the bracket and wherein the connector is configured to extend through the hole to connect and secure the mounting bracket and the covered rain gutter to the structure.

5. The rain gutter system of claim 1, wherein the elongated covered rain gutter is made from a single piece of material.

6. The rain gutter system of claim 1, wherein the top portion of the bracket forms a convex rounded portion that supports the nose portion of the cover portion of the covered rain gutter.

7. The rain gutter system of claim 1, wherein the bottom portion of the mounting bracket is configured to secure to the interior side of the lip.

8. A rain gutter system for connecting to a structure, comprising:

a covered rain gutter comprising:

a trough portion having a front wall and a rear wall connected by a bottom wall, the front wall comprising a first portion that extends upward and outward from the bottom wall and a second portion that extends upward and rearward from the first portion, the second portion connected to a flange forming and terminating in a lip, the lip extending downward and rearward toward the rear wall at an angle of between −90 and 0 degrees relative to horizontal; and a cover portion having a front wall connected to the rear wall of the trough portion via a top wall, the cover portion extending over the trough portion, the front wall of the cover portion extending at least partially over the trough portion and defining an opening to an interior of the covered rain gutter, the opening defined between the front wall of the cover portion and an end of the trough portion, the front wall of the cover portion configured to direct water to flow from an outside surface of the top wall toward the interior of the covered rain gutter;

a mounting bracket for positioning in the interior of the covered rain gutter and configured to support the covered rain gutter, the mounting bracket comprising:

a top portion configured to contact at least one of an interior side of the front wall or the top wall of the cover portion;

a bottom portion configured to contact the front wall of the trough portion;

the top portion and the bottom portion configured to maintain the opening to the interior of the covered rain gutter defined between the front wall of the cover portion and the end of the trough portion; and a central portion interconnecting the top portion and the bottom portion of the mounting bracket.

9. The rain gutter system of claim 8, wherein the bottom portion of the mounting bracket is configured to secure to the end of the trough portion with a fastener.

10. The rain gutter system of claim 9, wherein the top portion and the bottom portion of the mounting bracket maintain the opening to the interior of the covered rain gutter, defined between the front wall of the cover portion and the end of the trough portion, to be less than or equal ½ inch.

11. The rain gutter system of claim 8, wherein the covered rain gutter is formed from a single piece of material.

12. The rain gutter system of claim 8, wherein the covered rain gutter further comprises an elongated portion that connects the top wall to the rear wall of the cover portion, the elongated portion configured to sit behind flashing to prevent water from seeping between the structure and the covered rain gutter.

13. The rain gutter system of claim 8, wherein the front wall of the cover portion comprises a fold, the bottom of the fold defining the opening to the interior of the covered rain gutter.

* * * * *